US010096181B2

(12) United States Patent
Reymann

(10) Patent No.: US 10,096,181 B2
(45) Date of Patent: Oct. 9, 2018

(54) HANDS-FREE FARE GATE OPERATION

(71) Applicant: Cubic Corporation, San Diego, CA (US)

(72) Inventor: Steffen Reymann, Reigate (GB)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 15/820,925

(22) Filed: Nov. 22, 2017

(65) Prior Publication Data

US 2018/0144563 A1 May 24, 2018

Related U.S. Application Data

(60) Provisional application No. 62/425,475, filed on Nov. 22, 2016.

(51) Int. Cl.

| | |
|---|---|
| ***G07C 9/00*** | (2006.01) |
| ***E05F 15/76*** | (2015.01) |
| ***E06B 11/02*** | (2006.01) |

(52) U.S. Cl.

CPC ..... *G07C 9/00031* (2013.01); *E05F 15/76* (2015.01); *E06B 11/02* (2013.01); *E05Y 2900/40* (2013.01)

(58) Field of Classification Search

CPC ..... G07C 9/00031; E05F 15/76; E06B 11/02

See application file for complete search history.

(56) References Cited

U.S. PATENT DOCUMENTS 7,822,666 B1 * 10/2010 Bursch ..... G06F 21/34 235/380
2005/0087424 A1 4/2005 Newsome et al.
2014/0049361 A1 * 2/2014 Ahearn ..... G07C 9/00309 340/5.7
2015/0120558 A1 4/2015 Andrews et al.
(Continued)

FOREIGN PATENT DOCUMENTS

EP 2991041 A2 3/2016

OTHER PUBLICATIONS

International Search Report and Written Opinion dated Feb. 9, 2018 for PCT/US2017/062992; all pages.

*Primary Examiner* — Nabil Syed
(74) *Attorney, Agent, or Firm* — Kilpatrick Townsend & Stockton LLP

(57) ABSTRACT

An access gate that controls access to a restricted area, the access gate includes a communications interface having a long range wireless beacon and a short range radio frequency beacon. The gate includes a movable physical barrier, a processing unit, and a memory. The memory has instructions stored thereon that cause the processing unit to detect, using the long range beacon, the presence of a mobile device, receive, using the long range beacon, an access credential from the mobile device, and validate the access credential. The memory also has instructions that cause the processing unit to determine, using the short range radio frequency beacon, that the mobile device is within a threshold distance of the access gate and manipulate the movable physical barrier to allow access to a user of the mobile device based on the determination that the mobile device is within the threshold distance of the access gate.

18 Claims, 6 Drawing Sheets

(56) References Cited

U.S. PATENT DOCUMENTS

2015/0332530 A1* 11/2015 Kishita ..... B60R 25/245
70/256
2016/0055693 A1* 2/2016 Somani ..... G07B 15/02
340/5.61

* cited by examiner

HANDS-FREE FARE GATE OPERATION

CROSS-REFERENCES TO RELATED APPLICATIONS

This application claims the benefit of U.S. Provisional Patent Application No. 62/425,475, filed Nov. 22, 2016, entitled "HANDS-FREE FARE GATE OPERATION," the entirety of which is hereby incorporated by reference for all intents and purposes.

BACKGROUND OF THE INVENTION

Areas that are restricted to only credentialed individuals, such as transit systems, sports arenas, controlled workplace areas, and the like, often use doors, gates, and/or other physical barriers to prevent unauthorized users, such as unticketed passengers or event attendees, from entering the restricted area. Conventionally, to move or unlock a physical barrier, a user must interact with a credential reader that is part of or in communication with the barrier. For example, a user must insert a ticket and/or pass a radio frequency (RF) media in front of a media reader to provide a credential to the barrier to gain access to the restricted area. This requires the user to hold a ticket or a device in his hand in order to gain access, which not only may inconvenience the user, but may cause backlogs as multiple users in a row have to locate and present the access ticket or device.

BRIEF SUMMARY OF THE INVENTION

Embodiments of the invention described herein enable a fare gate to automatically interact with a passenger's mobile device (e.g., mobile phone) at a distance, validate permission to travel, and automatically open (e.g., by removing a physical barrier, causing a physical barrier to be movable, and/or otherwise granting a passenger physical access) when the passenger is in front of the fare gate paddles. The invention describes methods that ensure secure and verifiable operation of such a system and ways to ensure reliability of operations with respect to passenger position and movement in front of the fare gate.

In one aspect, an access gate that controls access to a restricted area is provided. The access gate may include a communications interface having a long range wireless beacon and a short range radio frequency beacon. The access gate may also include a movable physical barrier, a processing unit, and a memory. The memory may include instructions stored thereon that when executed cause the processing unit to detect, using the long range wireless beacon, the presence of a mobile device, receive, using the long range wireless beacon, an access credential from the mobile device, and validate the access credential. The instructions may also cause the processing unit to determine, using the short range radio frequency beacon, that the mobile device is within a threshold distance of the access gate and manipulate the movable physical barrier to allow access to a user of the mobile device based on the determination that the mobile device is within the threshold distance of the access gate.

In another aspect, an access gate that controls access to a restricted area includes a communications interface having a long range wireless beacon and a short range radio frequency assembly that includes a first short range radio frequency beacon and a second short range radio frequency beacon. The access gate may also include a movable physical barrier, a processing unit, and a memory. The memory may include instructions stored thereon that when executed cause the processing unit to detect, using the long range wireless beacon, the presence of a mobile device, receive, using the long range wireless beacon, an access credential from the mobile device, and validate the access credential. The instructions may also cause the processing unit to detect, using the short range radio frequency assembly, the presence of the mobile device, determine a signal strength of each of the first short range radio frequency beacon and the second short range radio frequency beacon, and determine, using the short range radio frequency beacon, that the mobile device is within a threshold distance of the access gate based on the determined signal strength of each of the first short range radio frequency beacon and the second short range radio frequency beacon. The instructions may further cause the processing unit to manipulate the movable physical barrier to allow access to a user of the mobile device based on the determination that the mobile device is within the threshold distance of the access gate.

In another aspect, a method for controlling access to a restricted area is provided. The method may include detecting the presence of a mobile device using a long range wireless beacon, receiving an access credential from the mobile device using the long range wireless beacon, and validating the access credential at an access control device. The method may also include determining that the mobile device is within a threshold distance of the access control device using a short range radio frequency beacon of the access control device and manipulating a movable physical barrier of the access control device to allow access to a user of the mobile device based on the determination that the mobile device is within the threshold distance of the access control device.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

Figure 1:
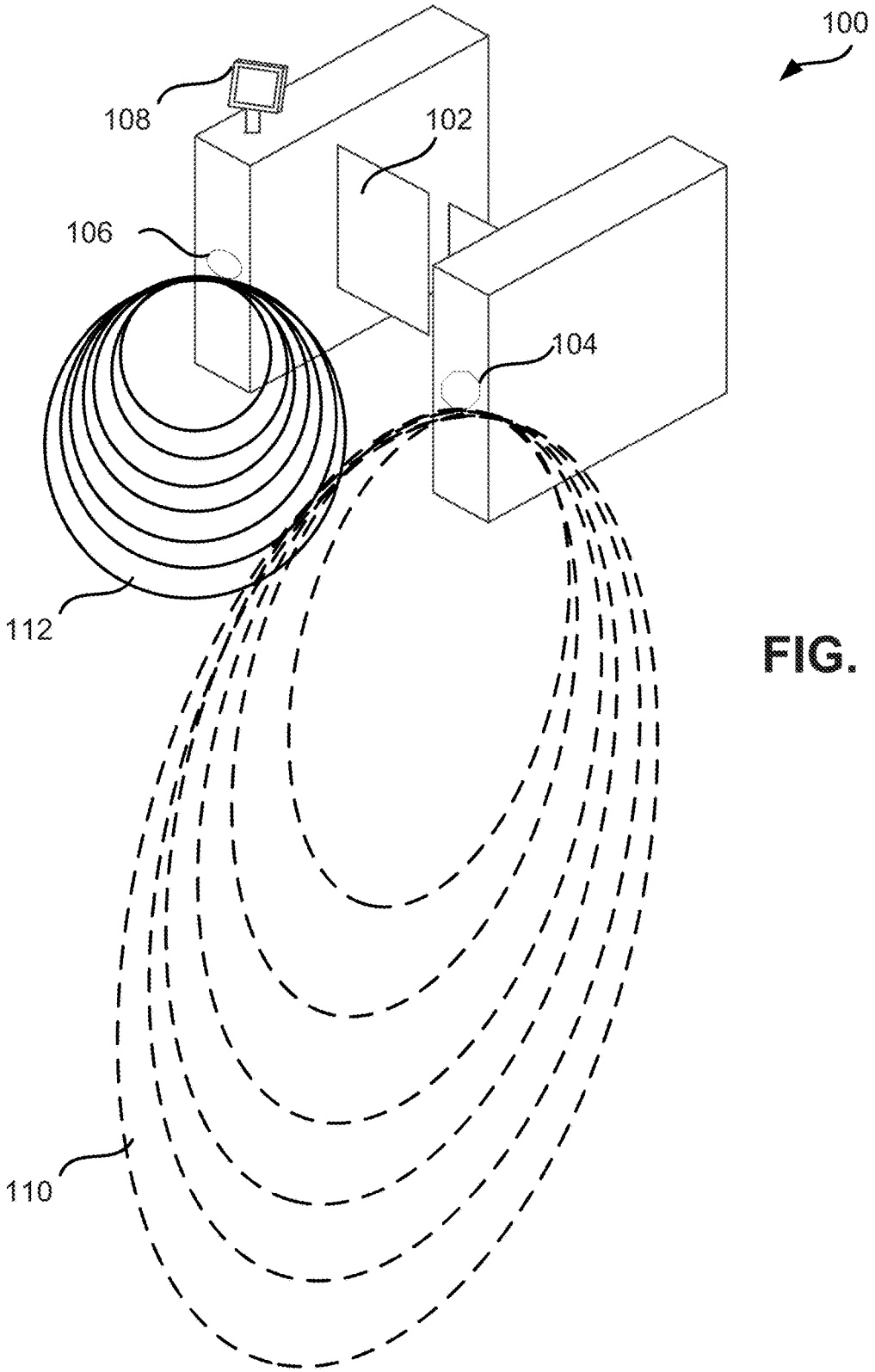
FIG. 1 depicts a hands free access gate system according to embodiments.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Systems, methods, and techniques are provided in the present disclosure for implementing a hands free access system. The systems described herein may improve passenger throughput across stations and lines of a city rapid transit system without the need for expanding current transit systems with additional gates and transit personnel. Bluetooth and/or other wireless communications between long range beacons and a user's mobile device may allow the system identify and validate users at a distance from an access gate, while short range beacons may be used to determine when the mobile device is near the gate such that the gate may be automatically unlocked and/or moved for a particular user, thereby providing a hands-free experience for users.

Embodiments of the invention(s) described herein are generally related to public transit. It will be understood, however, that the applications for the invention(s) are not so limited. The general concepts described herein may be applied, for example, to other applications where access gates and/or other barriers may be used to restrict access, such as stadiums, amusement parks, and other venues, regardless of whether a fare or other access credential is actually required. Embodiments of the present invention are directed to the use of wireless communications between a phone (or other mobile wireless device) and a fare gate (or other access device) to validate an access credential of a user without the user needing to actively swipe or otherwise position a phone or other access media in front of a media reader. Specifically, by using broadcast radio frequency (RF) technologies such as Bluetooth Low Energy (BLE) which is now ubiquitous in mobile devices, an access control device may communicate with a mobile device as the user approaches the access device. The access device may then validate any access credential prior to the user reaching a physical barrier of the access device. Upon successful validation of the access credential, the access device may detect when the user is nearby and automatically unlock or move the barrier out of the user's way to grant physical access to the restricted area.

Embodiments of the invention provide techniques for operating such a system reliably for mobile device models with different RF transmission characteristics, methods for providing immediate feedback to passengers as they pass through the gate, and techniques for securing the interaction between passenger's mobile device and gate.

The techniques described herein can provide any of a variety of novel aspects. For example, embodiments may provide "two factor" techniques that enable pre-authorization of a user's right to access a restricted area before approaching the gate or other barrier, as well as the calculation of unique access token prior to the user being in close proximity to the gate. In some embodiments, an expected phone/mobile device transmitter database may be pre-seeded with nearby mobile devices to ensure reliable operation in a crowded environment. In some embodiments, the entity maintaining the secured area may broadcast verifiable access tokens to enable the gate to determine the validity of a credential and to ensure integrity of the overall system (e.g., tickets and/or other access credentials cannot be cloned or copied). In some embodiments, a location of the access gate and/or a time limitation may be included in a broadcast of an access token. This allows an access gate to verify that a particular access token is valid for gaining entry at the particular access device at a particular time.

Embodiments of the invention may utilize multiple gate receivers to enable accurate positioning of mobile device and to remove RF transmission bias, while in other embodiments phone/mobile device model-specific signal strength parameters may be provided to the access gate to determine a distance of the mobile device from the access gate. In some embodiments, a secondary gate receiver may be used to send validation feedback to the mobile device after the validation (successful or unsuccessful) of an access credential. Access gates may be configured to accept a number of types of access media which are usually presented by the user to a reader on the gate at close distance. Access credentials may then be authenticated by the gate reader.

Oftentimes, BLE broadcast technology may be used for "beacon" applications. For instance, BLE technology may be used to broadcast offers in a shopping environment or directions in a station. According to some embodiments, a similar system could be constructed using long range RFID tags (active or passive) with dedicated gate receiver.

Used herein, the term "RFID" may refer to any communication technology employing electromagnetic fields to identify and track stationary or moving objects, including, but not limited to, Bluetooth and BLE RF technology. The term "RFID tag" may refer to any communication device that may be carried by or secured to an object. RFID tags may be passive, active, or battery-assisted passive. Active RFID tags have on-board batteries and periodically or constantly transmit wireless signals with identifying information. Battery-assisted passive RFID tags have small batteries on board and are activated when they are near an RFID reader. Passive RFID tags lack on-board batteries and are instead energized by the wireless signals received from RFID readers. RFID tags may have individual serial numbers or IDs that allow each individual RFID tag to be identified from among a larger group. In some embodiments, an RFID tag may be a credit card sized carrier or a key fob. RFID tags may operate in a 13.56 MHz band (HF), a 900 MHz band (UHF), or a 2.4 GHz band, among others. In some embodiments, UHF tags may co-exist with HF tags and vice-versa. In some embodiments, RFID tags may be used as tokens in an account based system so that only a serial number needs to be read to access an account. In other embodiments, a system may interact with the RFID tags and read and write data to them. For example, instead of an RFID tag containing information for linking to an account via a serial number or ID, the tag may ping back modifiable information regarding a balance. In some embodiments, an RFID tag may support mutual authentication to prevent spoofing or replay attacks. In some embodiments, active RFID tags may be turned on and off by a user pressing a button on or near the RFID tag. For example, a wheelchair user may press a button fixed to their wheelchair to power an active RFID tag. Such embodiments may save power and preserve battery life.

Used herein, the term "RFID reader" may refer to any communication device that may transmit and/or receive wireless signals to or from an RFID tag. The term "RFID reader" may be used interchangeably with the terms "RFID transceiver", "RFID transmitter", "RFID receiver", "transceiver", "transmitter", "receiver", "transmitter antenna", "receiver antenna", and "antenna". For example, in embodiments where several transceivers are disclosed as being positioned along the side of a gate cabinet and/or entry point, some embodiments may include transmitters and/or receivers being positioned along the side of the gate cabinet.

Similarly, in embodiments where several antennas are disclosed as being positioned along the side of a gate cabinet and/or entry point, some embodiments may include RFID transceivers, RFID transmitters, and/or RFID receivers as being positioned along the side of the gate cabinet and/or entry point.

An RFID transmitter may be a narrow beam antenna or an omnidirectional antenna, which, in some embodiments may cover a 180 degree hemisphere. An RFID fare collection system may comprise a single RFID transmitter or multiple transmitters. Similarly, an RFID receiver may be a narrow beamwidth antenna or an omnidirectional antenna. In some embodiments, a narrow beam antenna may be focused to eliminate unfavorable near field patterns. In some embodiments, multiple RFID receivers may share antenna elements in a phased array fashion, or may be individual, larger antennas for different channels. An RFID fare collection system may comprise RFID receivers on one side or both sides of a passageway. In some embodiments, antennas may have circular polarization so that they can communicate with RFID tags regardless of their orientation.

Turning now to FIG. 1, an access gate 100 is shown. In some embodiments, multiple access gates 100 may be provided in an array to control access. In some embodiments, one or more of the gates 100 may configured to handle access in a different direction. For example, some of the gates 100 in an array may manage access into a restricted area, while other gates 100 may mange access out of the restricted area. In some embodiments, a single gate 100 may be used to manage both entry and exit access. Access gate 100 may include one or more physical barriers 102 that may be unlocked and/or moved to allow a user to access a restricted area. Physical barriers 102 may include various types of physical barriers to impede access to a restricted access area, such as turnstiles, sliding doors, boom gates, and/or other barriers. The gates 100 may be used to control access to a restricted area, such as a transit system, event center, and/or other area requiring a ticket or other credential to gain access.

Each gate 100 may include at least one long range wireless beacon 104. Long range wireless beacon 104 may be positioned on the gate 100 and/or may be located remotely from the gate 100. For example, a single beacon 104 (or an array of beacons 104) may be located at a position that sets a detection range 110 of the beacon 104 at a desired distance from the access gate 100. In some embodiments, the beacon 104 may be positioned at a distance from the access gate 100 that provides sufficient time for the reception and validation of an access credential of a mobile device between the time the beacon 104 detects the mobile device and the time the user of the mobile device reaches the access gate 100. The long range wireless beacon 104 may utilize any number of wireless protocols, including BLE, WiFi, and the like. The detection range 110 of the wireless signal may be adjusted to cover a desired area outside (such as all or part of a transit station) of a restricted area. Operating at a relatively long range, in some embodiments the beacon 104 may trigger the mobile application to execute on a user's mobile device. Mobile devices may include mobile phones, laptops, tablet computers, smartcards, and/or other portable RF devices. The beacon 104 may detect the mobile device and may receive an access credential from the device. Access credentials may include tickets, access badges/identifiers, other forms of fare, and/or other credentials that an entity may use to determine whether a particular user is qualified to enter the restricted area. In some embodiments, these credentials may include information that identifies a particular user, such as their name, an identifier that is associated with the user, an authorization level, and the like. Oftentimes, the access credential is encrypted by mobile device before being sent to the access gate 100. For example, the credential may be encrypted using one pair of an asymmetric key pair, the time and/or date, and/or using other encryption techniques.

The initial detection of mobile devices and triggering of the mobile application or other software of the mobile device that sends access credentials to the beacon 104 can be done by a number of means. For instance, GPS geo-fencing (defining a zone containing the station area or other space near a restricted area) may allow a mobile device to determine when it is within the station area. Upon this determination, the mobile device may launch a mobile application that exchanges credential information with the beacon 104. In other embodiments, station-area RF beacons 104 (e.g., using Bluetooth or WiFi) may, upon detection by the mobile device, trigger the launching of the mobile application and/or the transmission of the access credential. In other embodiments, explicit user interaction (user launches the mobile application when arriving at the area and selecting their credential on the user interface of the mobile application) may be necessary to provide the access credential to the beacon 104.

Once the beacon 104 receives the access credential, the beacon 104 and/or the access gate 100 may decrypt the access credential (if necessary) and validate the access credential to determine whether the user has permission to access a restricted area. This validation may be done by the access gate 104 sending the access credential to a back office server, which may then verify the authenticity and/or validity of the access credential. The back office may then send an indication as to whether the validation was successful to the access gate 100. Using a back office for validation has a number of advantages. For instance, validation with a back office provides the ability to receive an encrypted credential token from the back office (based on the user's account id or other identifying information) and the ability for the back office to inform the gate 100 of the mobile device's unique identifier. The mobile device identifier may be used to prime a short range wireless beacon 106 of the gate 100 with expected ids (oftentimes with an allowed time duration), allowing the system to operate efficiently even in crowded RF environments that have many (unrelated) broadcasts potentially having a severe impact on performance. In other embodiments, the access gate 100 may validate the access credential itself. For example, the access gate 100 may retrieve a list of valid credentials and/or invalid credentials from the back office. The access gate 100 may then compare the credential received from the mobile device to those on the list(s) to validate the credential. In such embodiments, the credential may be held in a secure area of the mobile device memory (which may be specified and secured by a mobile application provided by the entity controlling the access gate and being executed by the mobile device) to ensure the authenticity of the credentials.

After validating the user's right to enter the restricted area at the current time/date, the mobile application receives (from the back office) or generates a credential token that is broadcast using the mobile device's RF technology (e.g., Bluetooth Low Energy or WiFi). The token is encrypted using public/private key pairs, with the gate 100 holding the current public part of the key. The token can contain a number of data fields allowing the gate 100 to re-verify the credential, for instance station/location identifier, a time/date, a user account identifier, and/or other information. In some embodiments, the token can also contain specific information pertaining to the mobile device model and its RF characteristics. This data is important as different devices will exhibit different RF behavior, making it difficult to determine exact range between the mobile device and the gate 100 without this data.

The access gate 100 may also include at least one short range radio frequency beacon 106. The short range RF beacon 106 may include at least one receiver or transceiver that is configured to receive credential token broadcasts from user's mobile devices as they approach the gate 100. The beacon(s) 106 may have a detection range 112 that extends only between sides of the access gate 100 such that once a mobile device is detected it is determined that the mobile device is sufficiently close to the gate 100 such that the barrier(s) 102 should be unlocked and/or opened automatically to permit the user of the mobile device access to the restricted area. In other embodiments, the detection range 112 may extend beyond the front of the access gate 100 such that the presence of a mobile device that has been successfully validated may be detected as the mobile device's user approaches the gate 100. In order to determine when to unlock and/or open the barrier 102, the short range RF beacon 106 may be configured to track a distance between the gate 100 and the mobile device.

Figure 2:
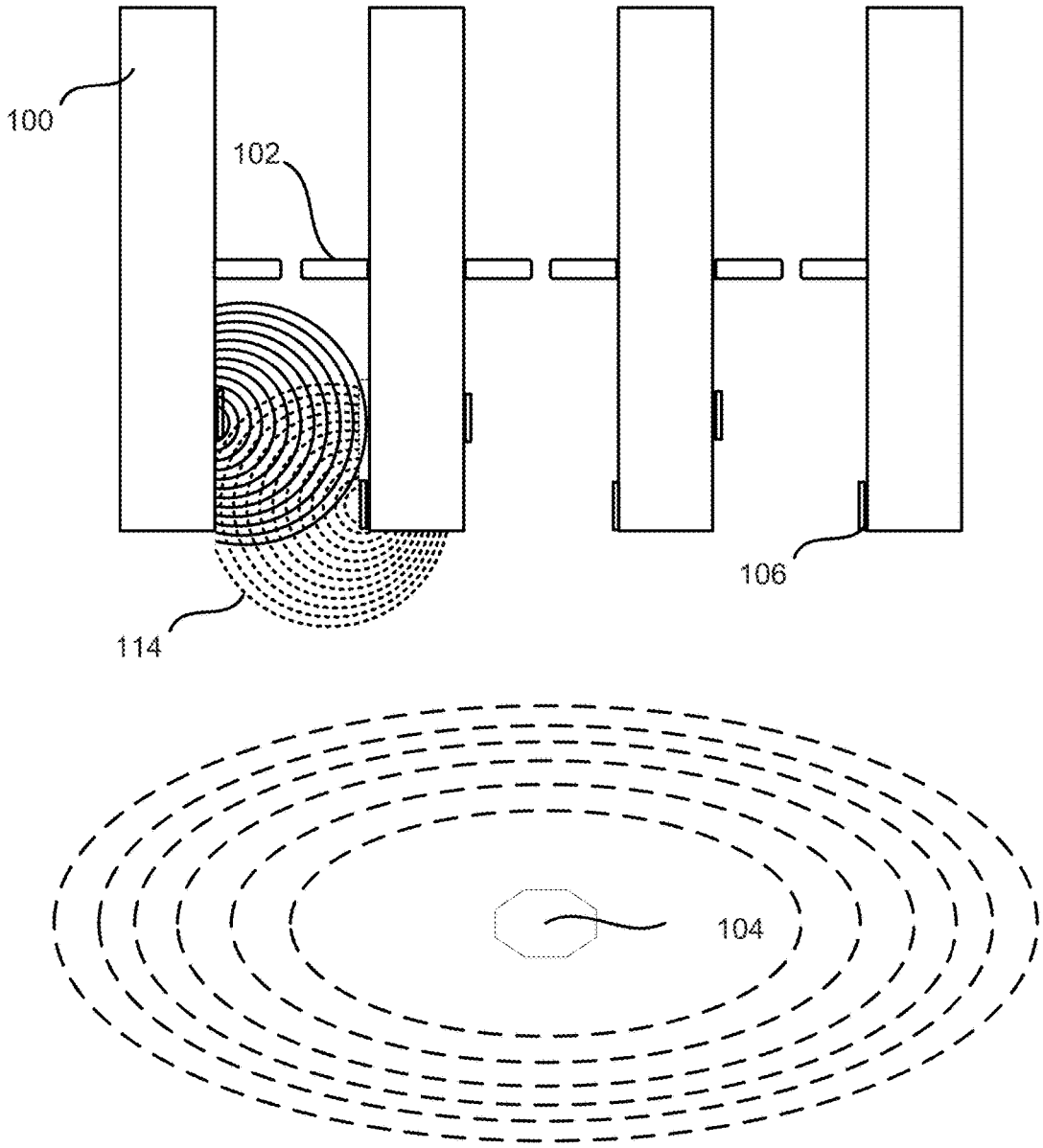
FIG. 2 depicts a hands free access gate system according to embodiments.

For example, the gate 100 and/or beacon 106 will also measure a signal strength indicator of any broadcast received. This signal strength indicator (typically referred to as RSSI—received signal strength indicator) gives a measure of relative distance between the mobile device and beacon 106. This RSSI is highly dependent on the particular mobile device model. Thus, the relationship between the RSSI and the actual distance is not deterministic. The present invention proposes two methods to solve this issue. In some embodiments, phone specific characteristic data may be embedded into the credential token broadcast. Using the data (for instance a multiplication factor c), the gate 100 and/or beacon 106 can calculate actual distance (in meters) based on RSSI measurement. For example, the equation: Distance=c*RSSI may provide the actual distance measurement for a particular mobile device. In other embodiments, the gate 100 may include multiple beacons 106 to determine the distance. For example, multiple receivers may be placed into the gate 100, such as shown in FIG. 2 to remove the phone model bias by calculating the difference in RSSI and using the outcome as a measure of distance. For example, assuming two different mobile device models with different RSSI characteristics $RSSI_{Phone1}$ and $RSSI_{Phone2}$. Each mobile device will exhibit a certain bias between them measured at the same distance x: $RSSI_{Phone1}(x)$ $RSSI_{Phone2}(x)$+bias, making determination of absolute distance unfeasible. However, when measuring RSSI on two or more receivers and calculating the difference the bias is removed: $\Delta RSSI=RSSI_{primary}-RSSI_{secondary}$. The gate 100 may be pre-configured (calibrated) with a ΔRSSI value corresponding to the desired threshold distance between the mobile device and the gate 100. When the range between the mobile device and the gate 100 and/or beacon(s) 106 falls below a certain pre-configured threshold distance (or ΔRSSI) that gate 100, after checking the received token broadcast for integrity, instructs the gate paddles or other barrier 102 to automatically unlock and/or open just prior to the arrival of the user of the mobile device, using an interface (software API or hardware) the gate 100 provides. The integrity check may consist of successfully decrypting the credential token and validating any additional information stored thereon against gate configuration parameters (e.g. access point location, time/date, etc.).

In a crowded environment with many RF mobile devices broadcasting it may be difficult for the gate beacon(s) to detect genuine credential broadcasts in a timely manner. The invention suggests a whitelist approach to solve this issue. The back office server, after having validated a user's permission to access the restricted area based on information received at long range wireless beacon 104, forwards the mobile device's device address to a local database. The lifetime of the mobile device address in the whitelist can be time limited, with enough duration to allow a user to pass from the outer boundaries of the detection range 110 of beacon(s) 104 to the gate 100 and detection range 112 of the short range RF beacon(s) 106. Using this database, the beacon(s) 106 can focus the search for credential broadcasts to the addresses in the current whitelist.

In some embodiments, in parallel with instructing the gate paddles or other barrier 102 to open, the system can use the beacon 106 temporarily as a validation broadcaster, sending a message to the mobile device that validation was successful (or unsuccessful). In this way the user can immediately proceed into the gate walkway, thereby speeding up throughput and the mobile application can stop broadcasting the access token. In some embodiments, an indication of the validation result may be provided on a display 108 posted on or around the gate 100. This indication may alert the user whether they are able to access the restricted area. In some embodiments, an audio indication may be provided. The gate system also puts the used credential token on a temporary blacklist. In this way, pass back of credentials is prevented as well as copying of credential token broadcasts by other devices. Such features are particularly useful in event and transit applications where a user's identity may not be directly tied to the credential, but rather actual possession of a valid credential is the determining factor in whether the user is allowed access to a restricted area.

In some embodiments, the short range RF beacon(s) 106 may continue to temporarily track the mobile device after opening the barrier 102. For example, the mobile device may be tracked until it is determined that the user and mobile device have actually passed through the gate 100 and barrier 102. Once this determination has been made, the gate 100 may be configured to lock the barrier 102 and/or move the barrier 102 into position to block access to the restricted area.

In some embodiments, the beacons 104 and/or 106 may be positioned on or near the gate 100. In some embodiments, the beacons 104 and/or 106 may be positioned within a threshold distance of the gate 100. The threshold distance may be determined based on several factors, such as the transmitting power of the beacons 104 and/or 106, the desired time needed for receiving and validating credentials from a mobile device, and the like. In some embodiments, the threshold distance may be 1 meter, 2 meters, 5 meters, 10 meters, 20 meters, and the like, with the distance being different for the beacons 104 and beacons 106.

Figure 3:
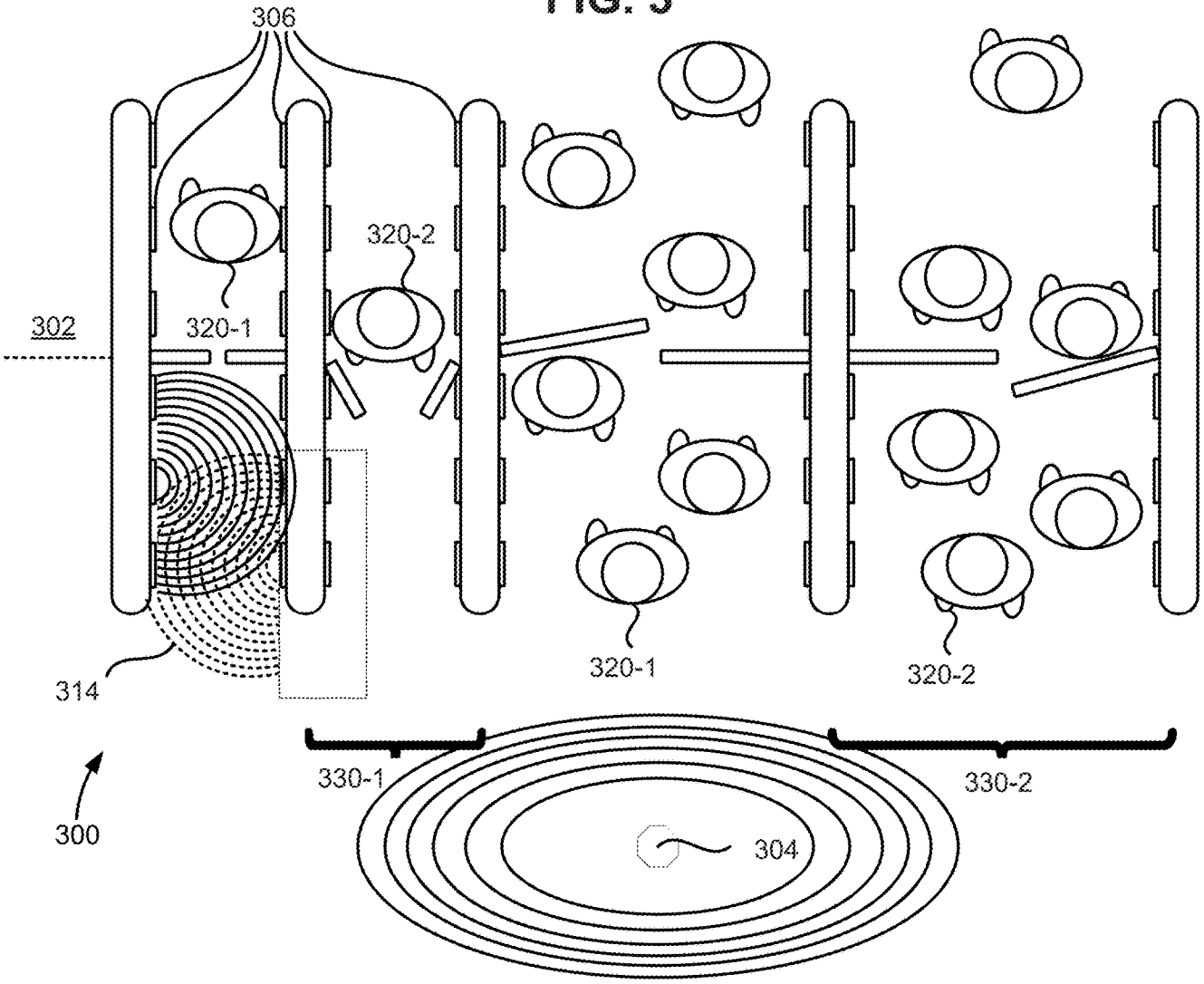
FIG. 3 depicts a hands free access gate system according to embodiments.

FIG. 3 shows a top view of a gate array 300 being accessed by users 320, according to some embodiments of the present disclosure. Gate array 300 may include one or more gates 330. Gates 330 may be similar to gates 100 described above. In some embodiments, the gate array 300 may include gates exclusively for entering users 320-1 or exiting users 320-2, such as gate 330-1, and/or may include gates with a sufficiently large passageway to accommodate users both entering and exiting the restricted access area 302, such as gate 330-2. In some embodiments, long range beacons 304 and/or short range beacons 306 may be equipped along the gates 330 to detect mobile devices carried by users 320 as they approach and pass through the gates 330. In some embodiments, the beacons 304 and/or 306 may comprise RFID transmitters, RFID receivers, or a combination of the two. For example, gate 330-1 may include RFID transmitters on the left side of a gate 330 and RFID receivers on the right side of a gate 330. In other embodiments, gate 330-1 may include a single RFID transmitter and a plurality of RFID receivers on both the left side of gate 330 and the right side of gate 330. In some embodiments, the beacons 304 and/or 306 are not positioned on the gates 330 themselves but are placed on the floor, the ceiling, or another suitable location within a threshold distance of the gate array 300. In some embodiments, a gate 330 includes multiple transceivers on a single side of the gate 330. The electromagnetic fields/detection ranges 314 of the short range beacons 306 may be configured to maximize coverage of the passageway of the RFID-enabled gate 330 through use of narrow beam antennas. In some embodiments, the electromagnetic fields 314 may have minimal overlap between adjacent beacons 306. In other embodiments, the electromagnetic fields 314 of adjacent beacons 306 may have no overlap or significant overlap. In some embodiments, transmission beacons 306 may be positioned on one side of a gate 330 and receiving beacons 306 may be positioned on an opposite side of the gate 330. One advantage of separating transmitters and receivers may be an increased simplicity of the data analysis.

In some embodiments, the gate 100 does not interrogate the credential to determine validity as the mobile application has control of where and when the credential is valid. This eliminates the need to hold accept or deny lists. The gate 100 will, however, check the integrity of any messages received and reject any "open" requests that do not pass these checks.

In some embodiments, the short range and/or long range beacons may use the connection-less advertisement (broadcast) capability contained in the Bluetooth 4.0 specification, which is supported by Bluetooth Low Energy (BLE) radio chipsets and is available on most modern smartphones and other wireless devices. This provides a relatively low power, fast connection that does not require the mobile devices to establish a connection. All capable BLE receivers can listen to all BLE broadcasts in an area, allowing the technology to operate in environments like transit systems that may have numerous user devices present within a signal range. In some embodiments, other protocols that define a data structure may be used. For example, Apple's™ "Proximity Beacon Specification" (better known as iBeacon®) and Google's™ open Eddystone® format may be used. The Eddystone® format actually defines a number of different payload types for a number of use cases. The iBeacon® protocol defines a 30 byte advertisement payload, formed out of two advertisement (AD) structures. In the second AD structure, 20 bytes are actually available for developers to utilize for their own purposes, split into a 16 byte "UUID" data packet and two 2 byte numbers called Major and Minor, which are meant to be used as region identifiers and are thus useful to identify an RTP gate data broadcast to the gate receiver (or a gate broadcast to the mobile app).

In some embodiments, a 16 byte data packet may be utilized for general data transmission and two additional 2 byte numbers as message identifiers. The interface may use specific, pre-defined Major and Minor numbers to uniquely identify a Real-Time Transport Protocol (RTP) gate data message. Any BLE broadcast not containing these numbers will be discarded by the gate receiver. To be able to easily distinguish app to gate messages from gate to app messages, two different Major numbers are used. For app to gate messages, the minor number is used as an additional unique identifier. For gate to app messages, the minor number may contain information with regards to the outcome of the token verification. In some embodiments, different Major and Minor numbers may be used to distinguish between different types of gate messages, different applications, different operators, etc.

The message format may make full use of the 16 bytes available in the broadcast payload. All values may be read as individual Hex characters, giving a total of 32 usable Hex digits (0-F). In some embodiments, bits 0 and 1 indicate to the gate 100 which direction (entry or exit) the application assumes the passenger should be passing through the gate 100. If both are set (or both are zero) they are ignored, this can user used by the mobile device to indicate that it is unable to determine direction. Bit 2 may indicate that the user has potentially two devices (e.g. a phone and a watch) broadcasting the same credential token. It allows the gate to accept either without recording a potentially fraudulent transaction. The outcome of credential validation by the gate may be contained in the Minor number of the return broadcast. For example, Minor number (four digits) is format xxyy, where xx is the walkway number the mobile device passed through (e.g. "53") and yy is the outcome code. It reuses the existing gate error codes that are displayed on the gate display.

The BLE packets may be broadcast to all receivers in range of a particular beacon. It is thus theoretically possible for an attacker to record the packet sent from the mobile device to the gate and replay to the gate receiver to open it. Two mechanisms are proposed to prevent possible man-in-middle/replay attacks. Specifically, passback and timestamp mechanisms may be implemented to prevent this. Passback (i.e. a user attempting to use the same credential/gate token twice on the same gate) is a known issue with some current credential types. The system will reject duplicate tokens that are sent from a mobile device to a gate within a defined period of time, with the gate being commanded not to open and possibly displaying an error code. Time stamping may be used to limit the life time of the data packet (credential) with a time stamp inside the encrypted data. For example, each credential token may contain a timestamp signifying the creation date of the credential token by the mobile application. The gate beacon may use this, together with a timeout value to validate timeliness of the token, similar to passback. If the token is received after (or before) the timestamp+timeout it will be rejected. The gate will not open and may display an error code. In addition, NLC and direction indicator may be verified. Both the mobile application and gate receiver 104 may log the (random) Bluetooth address, allowing the system to detect replay attacks. In instances where the current broadcast has expired, the mobile application may generate a new token with updated timestamp.

The actual data packet itself may be encrypted in order to prevent reverse engineering of the protocol by a third party listener and enable an attack that way. In some embodiments, the Advanced Encryption Standard (AES) may be used as the cypher, with the Electronic Codebook (ECB) as encryption mode. Such standards support the required 16 byte of encrypted data. The AES mechanism is symmetric, so only one secret key is used to encrypt and decrypt the data. The key may be rotated regularly for enhanced security. In other embodiments, an asymmetric (PKI) system may be used.

The mobile application may generate the data packet with the access credential, encrypt it with the (shared) secret key and then broadcast using a BLE (or other wireless protocol) standard. The long range gate beacon will decrypt using the secret key and validate the data structure. If this is not possible, the request will be rejected with an error code. Similarly for acknowledgment broadcasts from the gate to the mobile device, the gate may modify the original encrypted data packet, such as by using a digit swap procedure.

Once a message packet has successfully been received by a long range beacon and verified by the gate, the received signal strength indicator (RSSI) as detected by a short range beacon will be used to determine when to open the paddles or other barrier. In some embodiments, the mobile device may be configured (such as by using the mobile application) to broadcast the data packet at as high a frequency (low latency) as possible (typically >10 Hz). If the frequency is set too low it may be difficult to allow the gate to track the distance from the mobile device to the gate with sufficient accuracy. A setting for broadcast signal strength (~66 dBm, oftentimes between about 55 and 75 dBm) allows for the timely detection of the message by the gate (in order to be able to validate the message packet) and tracking of the mobile device towards the gate. If the signal strength is set too high system performance may potentially suffer by detecting and tracking phones that are still far away from the gate receiver. If the signal strength is set too low the system may detect phones at too short a distance to allow accurate tracking to the gate.

Figure 4:
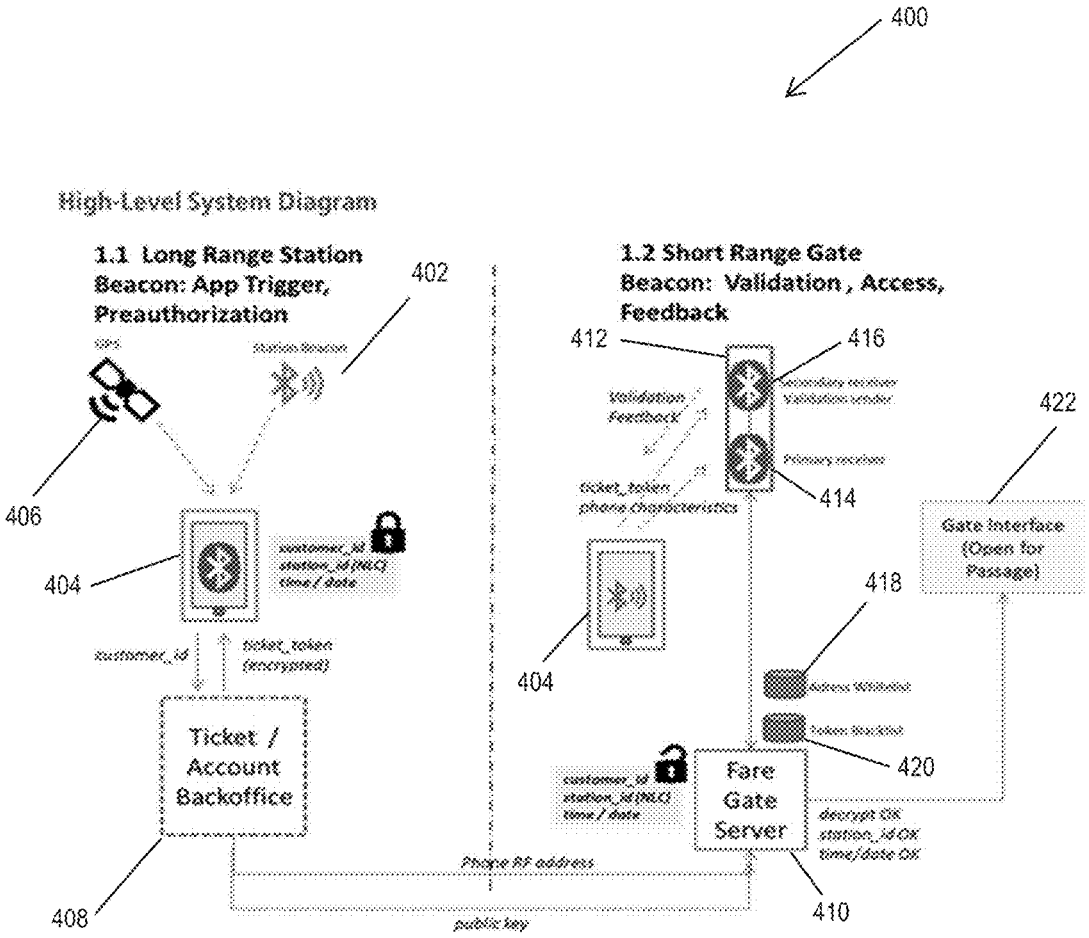
FIG. 4 depicts a system diagram of a hands free access gate system according to embodiments.

FIG. 4 depicts system diagram of a system 400 for providing hands free access to a restricted area. System 400 may operate with gates and gate components similar to those described in other embodiments, such as those described in relation to FIG. 1. System 400 may include a long range station beacon 402, which may operate using an RF protocol such as BLE to produce a signal that is emitted at a range covering a relatively large area, such as an entire transit station. It will be appreciated that multiple beacons 402 may be utilized to get the desired signal coverage. The beacon 402 may detect the presence of a mobile device 404, such a mobile phone, tablet computer, e-reader, smartcard, and the like. The detection may be done by the BLE signal detecting the presence of the mobile device 404 and sending a command that causes the mobile device 404 to launch a mobile application associated with the restricted area. In other embodiments, geofencing may be used. For example, the mobile device 404 may retrieve its GPS coordinates from a GPS system 406 and compare those coordinates to a geofence boundary defining the station. The mobile device 404 may include one or more access credentials, such as a customer id, a station/location id, a time/date, and/or other access data. The mobile device 404 may provide the station beacon 402 with the credential, such as the customer id, which may then be passed to a back office 408 for validation. Oftentimes, the credential or token is encrypted by the back office 408. In other embodiments, only the customer id is provided to the back office 408, which uses the id to retrieve a ticket or other credential and provides this credential in encrypted form to the mobile device 404 via the station beacon 402. Upon successful validation, the back office 408 may provide a radio frequency (RF) address of the mobile device 404 and a public key to a gate server 410.

The mobile device 404 may then move within range of at least one short range gate beacon 412. Here, short range gate beacon 412 includes a primary receiver or transceiver 414 and a secondary receiver or transceiver 416, although a single receiver or transceiver (or larger numbers) may be used. Once in range of the short range gate beacon 412, the mobile device 404 may provide the encrypted token (or a device/customer id) to at least one of the receivers 414, 416. Oftentimes, the receivers 414, 416 are in communication with the gate server 410 as well as a token database 418 and/or an address database 420. This credential (token or id) may be decrypted using the key received by the gate server 410 and compared by the gate server 410 to credentials in the databases 418, 420. If a match is found, the receivers may determine whether the mobile device 404 is within a threshold distance of a gate. This may be done using only the primary receiver 414. For example, the mobile device 404 may share its RF operating characteristics with the receiver 414, allowing the receiver to calculate an exact distance using the characteristics in combination with the RSSI of the signal between the mobile device 404 and the primary receiver 414. In other embodiments, the mobile device 404 may not share these characteristics and instead the difference between RSSI of the primary receiver 414 and the secondary receiver 416 may be used to determine the distance between the mobile device 404 and the gate. Once the mobile device 404 is within the threshold distance, the gate server 410 may send a command to a gate interface 422 that causes a physical barrier to automatically unlock and/or move to grant physical passage of the user to the restricted area.

Figure 5:
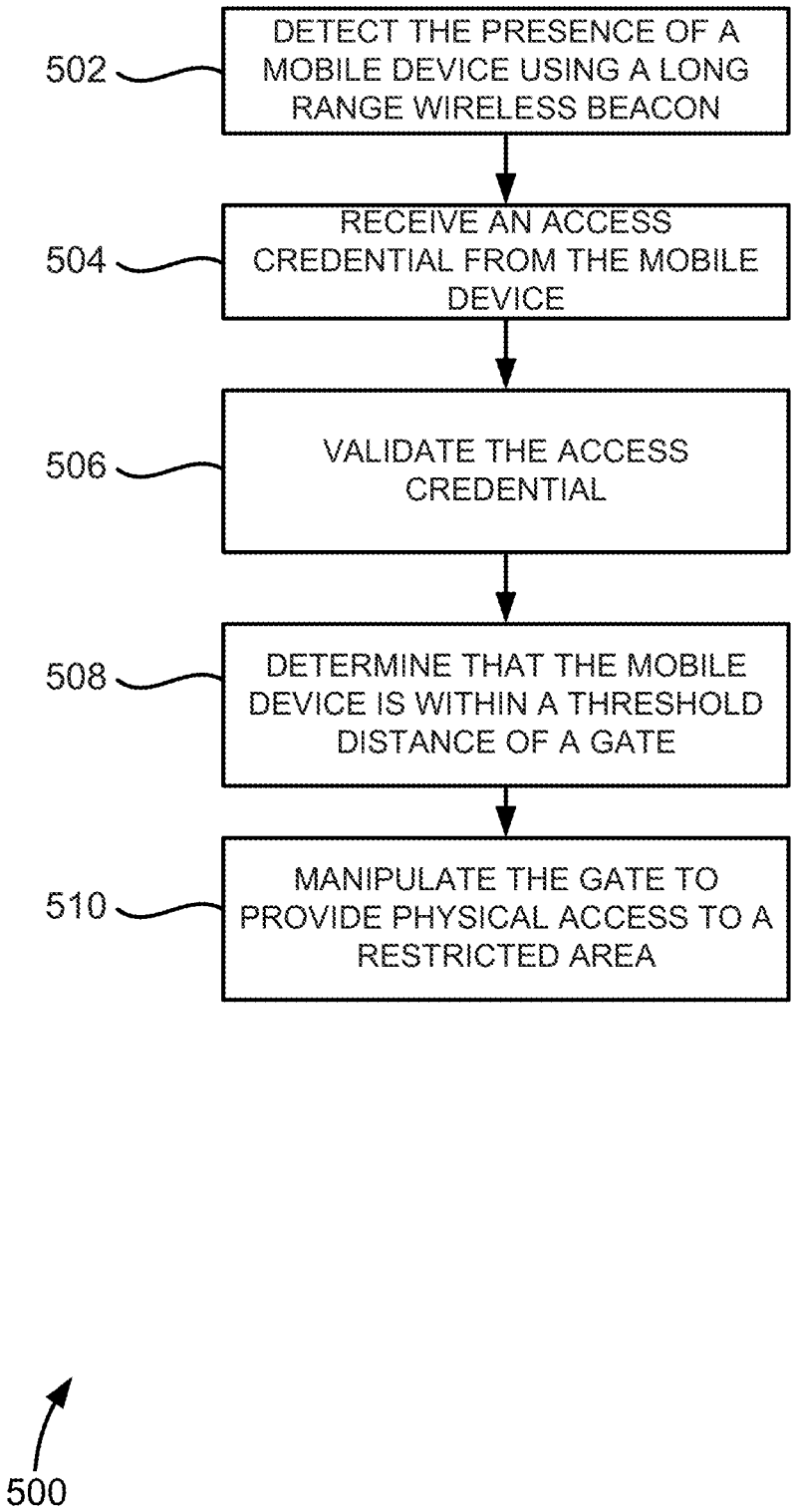
FIG. 5 is a flowchart depicting a process for controlling access to a restricted area according to embodiments.

FIG. 5 depicts a process 500 for controlling access to a restricted area. Process 500 may be performed by any access gate, such as gate 100 described herein. Process 500 may be used to control access to any kind of restricted area, such as a transit system, event center, restricted area of a workplace, and/or other area where entrants need to be properly credentialed. Process 500 may begin at block 502 by detecting the presence of a mobile device using a long range wireless beacon. In some embodiments, this may be done using a BLE beacon (or other wireless beacon) that broadcasts a signal that causes BLE-enabled mobile devices to launch a mobile application that is associated with accessing the restricted area. In other embodiments, a geofence may be established near the restricted area, such as around a transit system station. Once a mobile device detects (using its own GPS system) that it is within the geofence, the mobile device may automatically trigger the mobile application to launch and communicate with the long range wireless beacon. The beacon and/or mobile device may then check the memory of the mobile device (or the back office) for a valid access credential. At block 504, an access credential may be received from the mobile device using the long range wireless beacon. The access credential may include a ticket, mobile device identifier, work identification data, personal identification information, and/or any other information that is necessary for accessing a restricted area. In some embodiments, the mobile device may encrypt the credential prior to communicating the credential to the gate. For example, the credential may be encrypted using one key of a public/private asymmetric key pair and/or using a current time and/or date.

The access credential may be validated at an access control device at block 506, such as the gate. In embodiments where the credential is encrypted, the gate may first decrypt the credential, such as by using a public key of an asymmetric key pair. In some embodiments, validation may be done by comparing the credential (which may be a ticket or mobile device identifier, etc.) to a list of valid or blacklisted credentials provided by a back office. In other embodiments, the credential may be passed to the back office for validation. Upon being validated, the valid credential and/or a device identifier may be used to populate a list of expected devices. The list may include all devices that are currently detected (or have been detected within a threshold time period, such as the last 5 or 10 minutes) that are preauthorized by having or being associated with valid credentials. The lists may include devices for users that are expected to attempt to gain access through the gate. In some embodiments, these lists may be time limited such that the credentials and/or mobile devices are only pre-authorized for a short period of time after the mobile device is first detected by the long range wireless beacon.

At block 508, a determination may be made that the mobile device is within a threshold distance of the access control device using at least one short range radio frequency beacon of the access control device. For example, the gate may include multiple short range RF beacons. A signal strength of communications between the mobile device and at least two of the short range RF beacons may be measured and compared to calculate a distance between the mobile device and the gate. This calculation may determine the distance relative to each beacon and/or may include a constant value that allows a distance to a moveable barrier of the gate to be derived. In other embodiments, the mobile device may communicate data related to the RF operating characteristics of the mobile device to the gate. These operating characteristics may help a single (or multiple) short range RF beacon determine a distance of the mobile device relative to the gate. The distance of the mobile device may be tracked until the mobile device is within a threshold distance of the gate, oftentimes within about a meter of the gate, although other distances may be used as the threshold distance.

Upon determining that the user and mobile device are within the threshold distance (and pre-authorized for access), the movable physical barrier of the access control device may be manipulated to allow access to a user of the mobile device at block 510. This may involve unlocking a turnstile or other gate mechanism such that a user may push through the gate. In other embodiments, all or a part of the barrier may be automatically moved out of the path of the user to grant the user physical access to the restricted area. Such techniques allows a user to walk through the gate without removing a mobile device from their pocket or bag, providing a hands-free experience that can increase user throughput at the gate.

In some embodiments, the short range RF beacon(s) may continue to temporarily track the mobile device after opening the barrier. For example, the mobile device may be tracked until it is determined that the user and mobile device have actually passed through the gate and barrier. Once this determination has been made, the gate may be configured to lock the barrier and/or move the barrier into position to block access to the restricted area.

Figure 6:
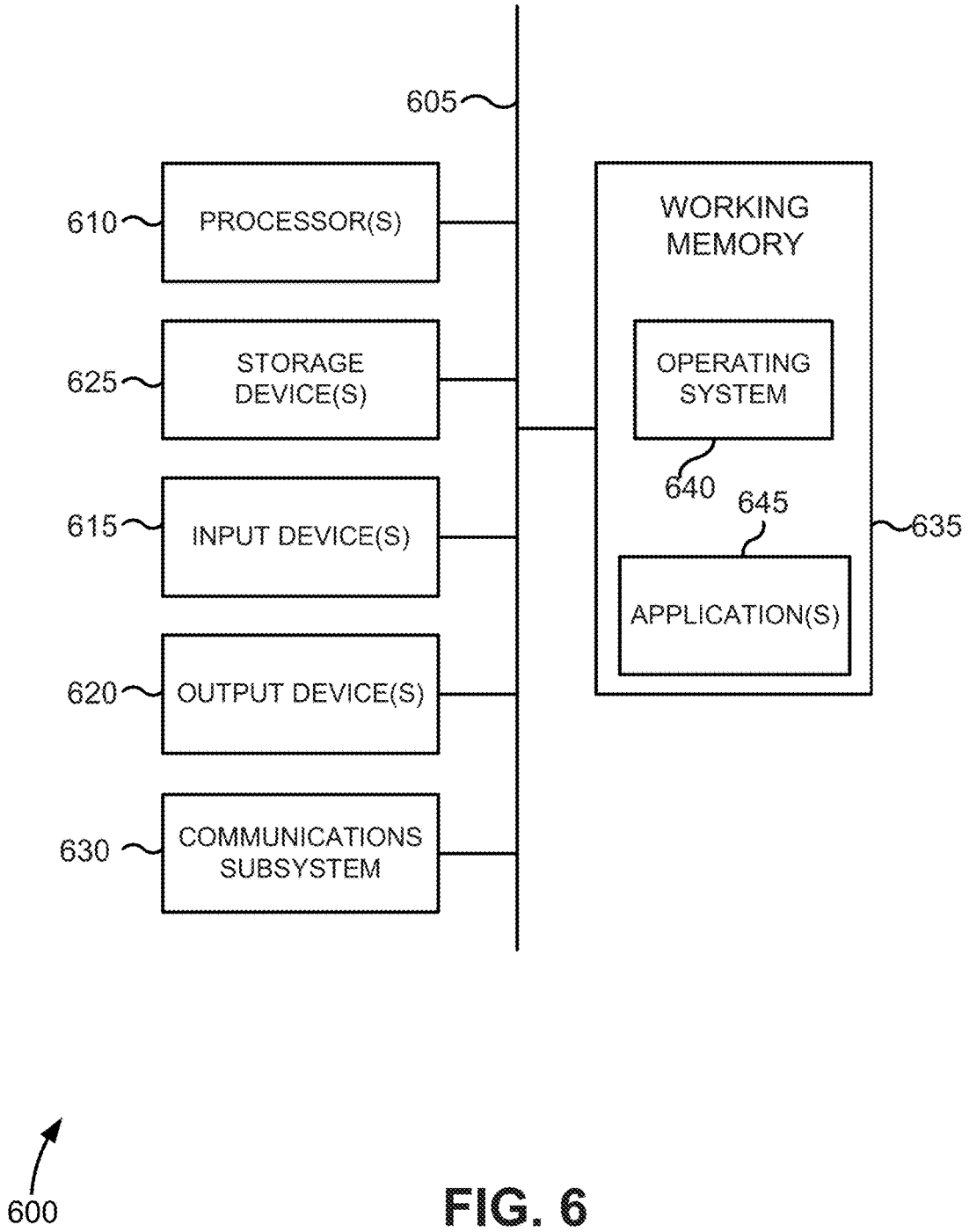
FIG. 6 is a block diagram of a computer system according to embodiments.

A computer system as illustrated in FIG. 6 may be incorporated as part of the previously described computerized devices. For example, computer system 600 can represent some of the components of the access control devices, mobile devices, back offices, and the like described herein. FIG. 6 provides a schematic illustration of one embodiment of a computer system 600 that can perform the methods provided by various other embodiments, as described herein. FIG. 6 is meant only to provide a generalized illustration of various components, any or all of which may be utilized as appropriate. FIG. 6, therefore, broadly illustrates how individual system elements may be implemented in a relatively separated or relatively more integrated manner.

The computer system 600 is shown comprising hardware elements that can be electrically coupled via a bus 605 (or may otherwise be in communication, as appropriate). The hardware elements may include a processing unit 610, including without limitation one or more processors, such as one or more special-purpose processors (such as digital signal processing chips, graphics acceleration processors, and/or the like); one or more input devices 615, which can include without limitation a keyboard, a touchscreen, receiver, a motion sensor, a camera, a smartcard reader, a contactless media reader, and/or the like; and one or more output devices 620, which can include without limitation a display device, a speaker, a printer, a writing module, and/or the like.

The computer system 600 may further include (and/or be in communication with) one or more non-transitory storage devices 625, which can comprise, without limitation, local and/or network accessible storage, and/or can include, without limitation, a disk drive, a drive array, an optical storage device, a solid-state storage device such as a random access memory ("RAM") and/or a read-only memory ("ROM"), which can be programmable, flash-updateable and/or the like. Such storage devices may be configured to implement any appropriate data stores, including without limitation, various file systems, database structures, and/or the like.

The computer system 600 might also include a communication interface 630, which can include without limitation a modem, a network card (wireless or wired), an infrared communication device, a wireless communication device and/or chipset (such as a Bluetooth™ device, an 502.11 device, a Wi-Fi device, a WiMAX device, an NFC device, cellular communication facilities, etc.), and/or similar communication interfaces. The communication interface 630 may permit data to be exchanged with a network (such as the network described below, to name one example), other computer systems, and/or any other devices described herein. In many embodiments, the computer system 600 will further comprise a non-transitory working memory 635, which can include a RAM or ROM device, as described above.

The computer system 600 also can comprise software elements, shown as being currently located within the working memory 635, including an operating system 640, device drivers, executable libraries, and/or other code, such as one or more application programs 645, which may comprise computer programs provided by various embodiments, and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such special/specific purpose code and/or instructions can be used to configure and/or adapt a computing device to a special purpose computer that is configured to perform one or more operations in accordance with the described methods.

A set of these instructions and/or code might be stored on a computer-readable storage medium, such as the storage device(s) 625 described above. In some cases, the storage medium might be incorporated within a computer system, such as computer system 600. In other embodiments, the storage medium might be separate from a computer system (e.g., a removable medium, such as a compact disc), and/or provided in an installation package, such that the storage medium can be used to program, configure and/or adapt a special purpose computer with the instructions/code stored thereon. These instructions might take the form of executable code, which is executable by the computer system 600 and/or might take the form of source and/or installable code, which, upon compilation and/or installation on the computer system 600 (e.g., using any of a variety of available compilers, installation programs, compression/decompression utilities, etc.) then takes the form of executable code.

Substantial variations may be made in accordance with specific requirements. For example, customized hardware might also be used, and/or particular elements might be implemented in hardware, software (including portable software, such as applets, etc.), or both. Moreover, hardware and/or software components that provide certain functionality can comprise a dedicated system (having specialized components) or may be part of a more generic system. For example, a risk management engine configured to provide some or all of the features described herein relating to the risk profiling and/or distribution can comprise hardware and/or software that is specialized (e.g., an application-specific integrated circuit (ASIC), a software method, etc.) or generic (e.g., processing unit 610, applications 645, etc.) Further, connection to other computing devices such as network input/output devices may be employed.

Some embodiments may employ a computer system (such as the computer system 600) to perform methods in accordance with the disclosure. For example, some or all of the procedures of the described methods may be performed by the computer system 600 in response to processing unit 610 executing one or more sequences of one or more instructions (which might be incorporated into the operating system 640 and/or other code, such as an application program 645) contained in the working memory 635. Such instructions may be read into the working memory 635 from another computer-readable medium, such as one or more of the storage device(s) 625. Merely by way of example, execution of the sequences of instructions contained in the working memory 635 might cause the processing unit 610 to perform one or more procedures of the methods described herein.

The terms "machine-readable medium" and "computer-readable medium," as used herein, refer to any medium that participates in providing data that causes a machine to operate in a specific fashion. In an embodiment implemented using the computer system 600, various computer-readable media might be involved in providing instructions/code to processing unit 610 for execution and/or might be used to store and/or carry such instructions/code (e.g., as signals). In many implementations, a computer-readable medium is a physical and/or tangible storage medium. Such a medium may take many forms, including but not limited to, non-volatile media, volatile media, and transmission media. Non-volatile media include, for example, optical and/or magnetic disks, such as the storage device(s) 625. Volatile media include, without limitation, dynamic memory, such as the working memory 635. Transmission media include, without limitation, coaxial cables, copper wire, and fiber optics, including the wires that comprise the bus 605, as well as the various components of the communication interface 630 (and/or the media by which the communication interface 630 provides communication with other devices). Hence, transmission media can also take the form of waves (including without limitation radio, acoustic and/or light waves, such as those generated during radio-wave and infrared data communications).

Common forms of physical and/or tangible computer-readable media include, for example, a magnetic medium, optical medium, or any other physical medium with patterns of holes, a RAM, a PROM, EPROM, a FLASH-EPROM, any other memory chip or cartridge, a carrier wave as described hereinafter, or any other medium from which a computer can read instructions and/or code.

The communication interface 630 (and/or components thereof) generally will receive the signals, and the bus 605 then might carry the signals (and/or the data, instructions, etc. carried by the signals) to the working memory 635, from which the processor(s) 605 retrieves and executes the instructions. The instructions received by the working memory 635 may optionally be stored on a non-transitory storage device 625 either before or after execution by the processing unit 610.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure. Furthermore, embodiments of the methods may be implemented by hardware, software, firmware, middleware, microcode, hardware description languages, or any combination thereof. When implemented in software, firmware, middleware, or microcode, the program code or code segments to perform the associated tasks may be stored in a computer-readable medium such as a storage medium. Processors may perform the associated tasks.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. An access gate that controls access to a restricted area, the access gate comprising:

a communications interface comprising:

a long range wireless beacon;

a first short range radio frequency beacon; and a second short range radio frequency beacon;

a movable physical barrier;

a processing unit; and a memory having instructions stored thereon that when executed cause the processing unit to:

detect, using the long range wireless beacon, the presence of a mobile device;

receive, using the long range wireless beacon, an access credential from the mobile device;

validate the access credential;

determine a signal strength at each of the first short range radio frequency beacon and the second short range radio frequency beacon;

determine, using the first short range radio frequency beacon and the second short range radio frequency beacon, that the mobile device is within a threshold distance of the access gate based on the determined signal strength at each of the first short range radio frequency beacon and the second short range radio frequency beacon; and manipulate the movable physical barrier to allow access to a user of the mobile device based on the determination that the mobile device is within the threshold distance of the access gate.

2. The access gate that controls access to a restricted area of claim 1, wherein the memory further includes instructions stored thereon that when executed cause the processing unit to:

populate a list comprising all of the mobile devices that are both currently detected by the long range wireless beacon and have validated access credentials associated therewith; and determine to grant access to the user of the mobile device based on the mobile device being present on the list.

3. The access gate that controls access to a restricted area of claim 2, wherein:

each of the mobile devices that are both currently detected by the long range wireless beacon and have validated access credentials associated therewith are included on the list for a predetermined time period before being removed.

4. The access gate that controls access to a restricted area of claim 1, wherein the memory further includes instructions stored thereon that when executed cause the processing unit to:

receive an encrypted access credential token and a mobile device identifier from a back office, wherein the access credential comprises an identifier of the mobile device, and wherein validating the access credential comprises comparing the mobile device identifier to the identifier of the mobile device.

5. The access gate that controls access to a restricted area of claim 1, wherein the memory further includes instructions stored thereon that when executed cause the processing unit to:

receive information pertaining to operating characteristics of the mobile device, wherein the determination that the mobile device is within the threshold distance of the access gate is based at least in part on the information pertaining to operating characteristics of the mobile device.

6. An access gate that controls access to a restricted area, the access gate comprising:

a communications interface comprising:

a long range wireless beacon; and a short range radio frequency assembly comprising a first short range radio frequency beacon and a second short range radio frequency beacon;

a movable physical barrier;

a processing unit; and a memory having instructions stored thereon that when executed cause the processing unit to:

detect, using the long range wireless beacon, the presence of a mobile device;

receive, using the long range wireless beacon, an access credential from the mobile device;

validate the access credential;

detect, using the short range radio frequency assembly, the presence of the mobile device;

determine a signal strength of each at the first short range radio frequency beacon and the second short range radio frequency beacon;

determine, using the short range radio frequency assembly, that the mobile device is within a threshold distance of the access gate based on the determined signal strength at each of the first short range radio frequency beacon and the second short range radio frequency beacon; and manipulate the movable physical barrier to allow access to a user of the mobile device based on the determination that the mobile device is within the threshold distance of the access gate.

7. The access gate that controls access to a restricted area of claim 6, wherein the memory further includes instructions stored thereon that when executed cause the processing unit to:

communicate an indication to the mobile device that the access credential was successfully validated.

8. The access gate that controls access to a restricted area of claim 6, wherein the memory further includes instructions stored thereon that when executed cause the processing unit to:

decrypt the access credential prior to validating the access credential.

9. The access gate that controls access to a restricted area of claim 6, wherein:

manipulating the movable physical barrier comprises moving the movable physical barrier to allow access to the user of the mobile device.

10. The access gate that controls access to a restricted area of claim 6, wherein:

manipulating the movable physical barrier comprises unlocking the movable physical barrier such that the user of the mobile device may move the moveable physical barrier to gain access to the restricted area.

11. The access gate that controls access to a restricted area of claim 6, wherein the memory further includes instructions stored thereon that when executed cause the processing unit to:

cause the mobile device to stop broadcasting the access credential upon manipulating the movable physical barrier.

12. A method for controlling access to a restricted area, the method comprising:

detecting the presence of a mobile device using a long range wireless beacon;

receiving an access credential from the mobile device using the long range wireless beacon;

validating the access credential at an access control device;

determining a signal strength at each of a first short range radio frequency beacon and a second short range radio frequency beacon of the access control device;

determining that the mobile device is within a threshold distance of the access control device using the first short range radio frequency beacon and the second short range radio frequency beacon of the access control device based on the determined signal strength of each of the first short range radio frequency beacon and the second short range radio frequency beacon; and manipulating a movable physical barrier of the access control device to allow access to a user of the mobile device based on the determination that the mobile device is within the threshold distance of the access control device.

13. The method for controlling access to a restricted area of claim 12, further comprising:

adding the access credential to a blacklist for a predetermined period of time upon manipulating the moveable physical barrier.

14. The method for controlling access to a restricted area of claim 12, wherein:

the threshold distance comprises a distance that extends just to a front end of the access control device.

15. The method for controlling access to a restricted area of claim 12, further comprising:

receiving information pertaining to operating characteristics of the mobile device, wherein the determination that the mobile device is within the threshold distance of the access gate is based at least in part on the information pertaining to operating characteristics of the mobile device.

16. The method for controlling access to a restricted area of claim 12, wherein:

manipulating the movable physical barrier comprises moving the movable physical barrier to allow access to the user of the mobile device.

17. The method for controlling access to a restricted area of claim 12, wherein:

manipulating the movable physical barrier comprises unlocking the movable physical barrier such that the user of the mobile device may move the moveable physical barrier to gain access to the restricted area.

18. The method for controlling access to a restricted area of claim 12, wherein:

the long range wireless beacon is remotely located from the access control device.

* * * * *